US010087047B2

(12) United States Patent
Kuppelwieser et al.

(10) Patent No.: US 10,087,047 B2
(45) Date of Patent: Oct. 2, 2018

(54) DOOR SYSTEM FOR AN ELEVATOR INSTALLATION

(71) Applicant: INVENTIO AG, Hergiswil (CH)

(72) Inventors: Ralph Kuppelwieser, Pratteln (CH); Ernst Lüthi, Brittnau (CH); Jonas Vonaesch, Lucerne (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/520,879

(22) PCT Filed: Oct. 23, 2015

(86) PCT No.: PCT/EP2015/074558

§ 371 (c)(1),
(2) Date: Apr. 21, 2017

(87) PCT Pub. No.: WO2016/062840

PCT Pub. Date: Apr. 28, 2016

(65) Prior Publication Data

US 2017/0334681 A1 Nov. 23, 2017

(30) Foreign Application Priority Data

Oct. 23, 2014 (EP) ..... 14190022

(51) Int. Cl.
*B66B 13/06* (2006.01)
*B66B 13/16* (2006.01)
(Continued)

(52) U.S. Cl.
CPC ..... *B66B 13/06* (2013.01); *B66B 13/16* (2013.01); *B66B 3/00* (2013.01); *B66B 5/00* (2013.01); *B66B 13/00* (2013.01)

(58) Field of Classification Search
CPC ..... B66B 13/06; B66B 13/16; B66B 5/00; B66B 3/00; B66B 13/00
See application file for complete search history.

(56) References Cited

U.S. PATENT DOCUMENTS 2,175,323 A * 10/1939 Shepard ..... E06B 3/481 160/206
2,784,465 A * 3/1957 Strobel-Fuchs ..... A61L 2/24 422/124

(Continued)

FOREIGN PATENT DOCUMENTS

EP 0794310 A1 9/1997
EP 2088273 A1 8/2009

(Continued)

*Primary Examiner* — Michael A Riegelman
(74) *Attorney, Agent, or Firm* — William J. Clemens; Shumaker, Loop & Kendrick, LLP

(57) ABSTRACT

A door system for an elevator installation having an elevator car with a car door arranged to travel in an elevator shaft with shaft doors, wherein the car door is spaced from the shaft doors in a closed position of the door system. A primary pivot spindle is coupled to a pivotable door leaf of the shaft door or the car door and a secondary pivot spindle is coupled to a pivotable door leaf of the other of the car door and the shaft door. A drive unit includes a driven, pivotably mounted shaft to which a first entrainer and a second entrainer are fixed. During a pivoting movement of the shaft, the first entrainer engages a first counterpart element on the primary pivot spindle and the second entrainer engages a second counterpart element on the secondary pivot spindle to effect a pivoting movement of the door leaves.

14 Claims, 6 Drawing Sheets

(51) Int. Cl.

| | |
|---|---|
| *B66B 3/00* | (2006.01) |
| *B66B 5/00* | (2006.01) |
| *B66B 13/00* | (2006.01) |

(56) References Cited

U.S. PATENT DOCUMENTS

| | | | | | |
|---|---|---|---|---|---|
| 3,348,628 | A | * | 10/1967 | Dixon | E06B 3/94 160/40 |
| 3,799,237 | A | * | 3/1974 | Proserpi | E06B 3/481 160/199 |
| 4,027,714 | A | * | 6/1977 | Dixon | E06B 3/94 160/84.08 |
| 4,324,189 | A | * | 4/1982 | Roldness | B61D 3/18 105/378 |
| 4,867,221 | A | * | 9/1989 | Dixon | E06B 3/94 160/199 |
| 2017/0334680 | A1 | * | 11/2017 | Kuppelwieser | B66B 13/06 |

FOREIGN PATENT DOCUMENTS

| | | | |
|---|---|---|---|
| FR | 1186950 | A | 9/1959 |
| JP | H10316334 | A | 12/1998 |

* cited by examiner

DOOR SYSTEM FOR AN ELEVATOR INSTALLATION

FIELD

The invention relates to a door system for an elevator installation and an elevator installation with such a door system.

BACKGROUND

Elevator installations are usually arranged in an elevator shaft, which connects a plurality of floors. The elevator shaft comprises shaft door openings at the level of the individual floors. Shaft doors are arranged at these shaft door openings. The elevator installation comprises an elevator car, which is arranged so as to be capable of travel inside the elevator shaft. The elevator car comprises a car door opening. The car door is arranged at this car door opening. Both the shaft doors and the at least one car door usually each comprise at least one door leaf.

EP 2 088 273 A1 shows an opening and closing mechanism for an elevator door constituted as a folding door. The elevator door comprises a door drive, a belt coupled to the door drive and a coupling gear fastened to this belt. The folding door comprises a leading and a trailing door leaf. The door drive is coupled to the leading door leaf in such a way that the leading door leaf is pivoted out of its door closing plane when the motor shaft of the door drive rotates and the doors are then opened. A drawback is that such a door system is complicated in design and comprises many individual parts.

SUMMARY

The problem of the invention, therefore, is to propose a door system for an elevator installation, said door system having a simple design.

The problem is solved by a door system for an elevator installation, said door system comprising a car door arranged on a car door side, a shaft door arranged on a shaft door side, wherein the car door and the shaft door can be arranged spaced apart from one another in the closed position of the door system, a primary pivot spindle of the shaft door or car door which can be coupled to a pivotable door leaf, wherein the door leaf and the primary pivot spindle can be arranged on a first of the sides comprising the car door side and the shaft door side, and a drive unit comprising a driven pivotably mounted shaft, wherein an entraining means of the drive unit is fixed to the pivotable shaft, and the drive unit can be arranged on a second of the sides comprising the car door side and the shaft door side, wherein a counterpart element which can be actuated by the entraining means is fixed to the primary pivot spindle in such a way that, during a pivoting movement of the shaft, the entraining means effects a pivoting movement of the primary pivot spindle and an associated pivoting movement of the door leaf can be effected, wherein the counterpart element can be actuated by the entraining means by means of a direct mechanical contact between counterpart element and entraining means.

The problem is also solved by an elevator installation with such a door system.

The invention is based on the knowledge that both the door leaf arranged on the non-drive side and the door leaf arranged, as the case may be, on the drive side can be driven by the drive unit without a complicated device, located in the drive train of the door leaf arranged on the drive side, being required for coupling the shaft door with the car door. This is achieved by the fact that the pivoting movement of the shaft coupled with the drive effects a pivoting movement of the pivot spindle arranged on the non-drive side by direct mechanical contact. The entraining means fastened to the shaft accordingly pivots into the gap present between the car door and the shaft door before an opening movement of the door leaf begins. After the entraining means has pivoted into this gap, the pivot spindle arranged on the non-drive side mechanically actuates the counterpart element with a continued pivoting movement of the shaft and thus triggers a pivoting movement of the non-drive side door leaf.

The door leaf, the primary pivot spindle and the counterpart element fixed to the primary pivot spindle are either components of the car door belonging, as the case may be, to the elevator car, or of the shaft door, which can be arranged at a shaft door opening of the elevator shaft. If the door leaf, the primary pivot spindle and the counterpart element fixed to the primary pivot spindle are accordingly components of the car door, the drive unit is consequently a component of the shaft door and vice versa.

The shaft and the primary pivot spindle are preferably arranged parallel with one another. Accordingly, a particularly space-saving embodiment of the door system is enabled, because a pivoting movement of the shaft can directly effect a pivoting movement of the primary pivot spindle, without linkages for power transmission being required.

A development of the door system is constituted as a folding door system. The effect of this is that the extensions of the door system normal to the door closing plane can be kept small in the open position of the door system.

In a development of the door system, the drive unit is arranged on the shaft door side or on the car door side. Each shaft door can have a specific mass to be moved during the opening and closing. An arrangement of the drive unit on the shaft door side thus has the advantage that the drive unit can be designed according to the mass of the shaft door concerned that is to be moved. The drive unit can thus be designed in the optimum manner with regard to the mass of the door system to be moved, said door system being formed by the car door and the shaft door. When the drive unit is arranged on the car door side, the cost-saving advantage arises that a single drive unit suffices to actuate all the shaft doors of the entire elevator installation.

A development of the door system comprises a secondary pivot spindle for fixing a further door leaf of the shaft door or car door, said secondary pivot spindle being arranged on the second of the sides comprising the car door side and the shaft door side. With the aid of a few components, both the shaft door and the car door can thus be operated by the drive unit of the door system. An actuation of both the primary and also the secondary pivot spindle thus taking place enables a coupling of the car door with the shaft door.

In a development of the door system, a second entraining means is fixed to the pivotable shaft. Furthermore, a second counterpart element which can be actuated by the second entraining means is fixed to the secondary pivot spindle, in such a way that the second entraining means effects a pivoting movement of the secondary pivot spindle when a pivoting movement of the shaft takes place. It is advantageous that the pivoting movement of the shaft can also effect the pivoting movement of the secondary pivot spindle.

In a development of the door system, the first and the second entraining means and the first and the second counterpart element is fixed to the shaft or to the pivot spindles in such a way that the pivoting movements of the primary pivot spindle and the secondary pivot spindle start essentially simultaneously with the opening and closing of the door system. The effect of this is that the door system can be opened and closed in an optimum short time. The capacity of the elevator installation is correspondingly increased.

In a development of the door system, a drive shaft of a motor of the drive unit and the driven pivotably mounted shaft are arranged coaxially. As a result of the coaxial arrangement of the drive shaft of the motor on the one hand and the pivotably mounted shaft on the other hand, a gear unit belonging to the drive unit can be dispensed with. The door system thus has a smaller space requirement.

In a development of the door system, a first of the at least one entraining means is constituted as a cam, and the counterpart element assigned to the first entraining means is constituted as an engaging element. A favorable and space-saving opportunity is thus provided for the design of the door system.

In a development of the door system, the pivot spindle of the door leaf assignable to the primary pivot spindle and the primary pivot spindle can be coupled by a coupling gear and/or the pivot spindle of the door leaf assignable to the secondary pivot spindle and the secondary pivot spindle can be coupled by a coupling gear. It thus becomes possible for the direction and/or speed of the pivoting movement of this door leaf to be adapted corresponding to the circumstances of the elevator installation during an opening and closing movement of the door system. The effect of this is also that the primary pivot spindle or the secondary pivot spindle and/or the pivot spindle of the associated door leaf can be arranged spaced apart from one another for space reasons. As an alternative to this, the pivot spindle of the door leaf assigned to the primary pivot spindle can be arranged coaxial with the primary pivot spindle and/or a pivot spindle of the door leaf assignable to the secondary pivot spindle can be arranged coaxial with the secondary pivot spindle. Additional components of the door system can thus be avoided and space can correspondingly be saved. As a result of this coaxial arrangement of the pivot spindle of the door leaf or the door leaves with the primary or secondary pivot spindle, savings can also be made on the assembly outlay during the installation of the door system in the region of the door opening to be closed.

In a development of the door system, the shaft and/or the pivot spindles can be arranged essentially as right angles inside the elevator installation. The arrangement at right angles makes it possible for door leaves mounted on the pivot spindles to be held in their open or closed position without a great deal of energy being expended.

DESCRIPTION OF THE DRAWINGS

The invention is explained in greater detail below with the aid of figures. In the figures.

DETAILED DESCRIPTION

Figure 1:
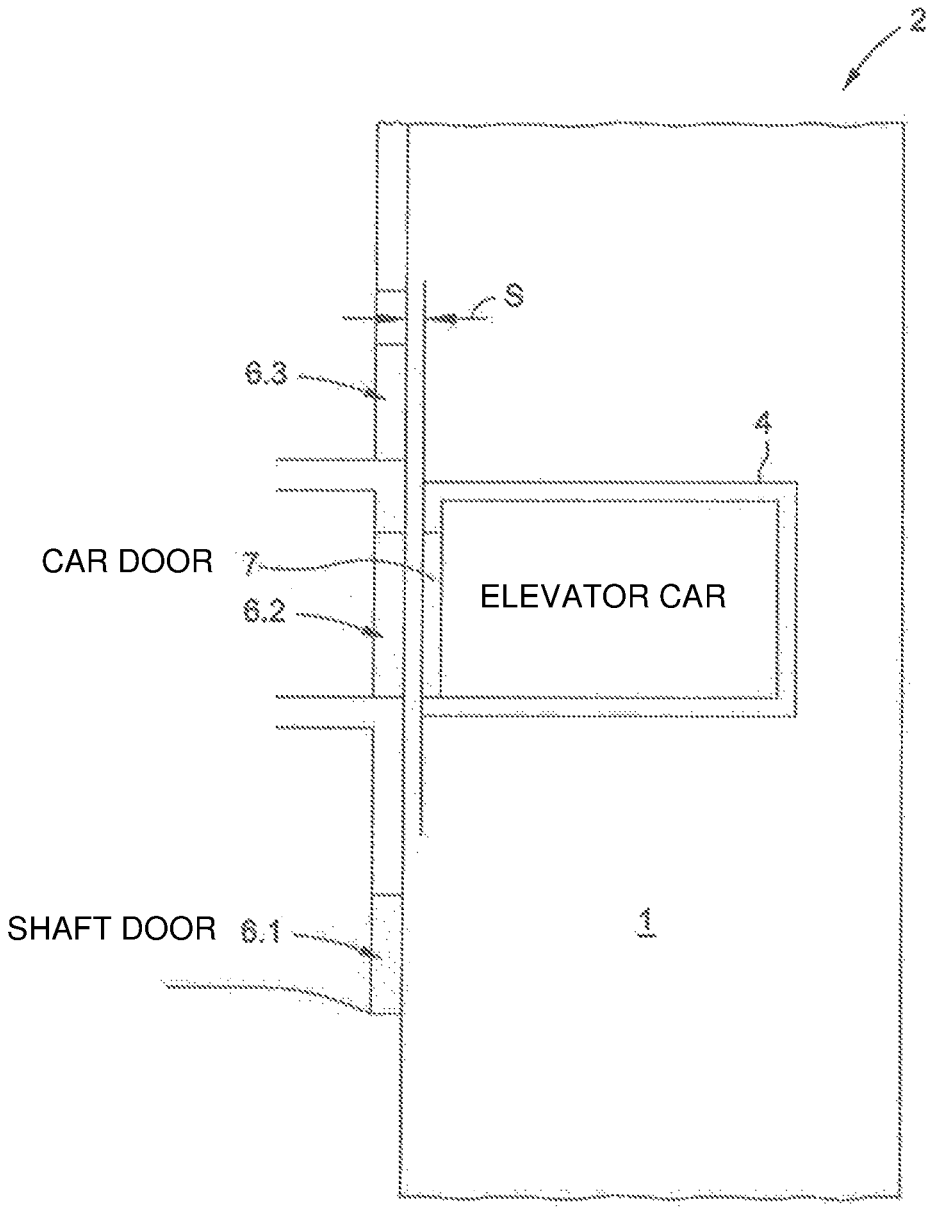
FIG. 1: shows an elevator installation with a door system.

FIG. 1 shows an elevator installation 2. Elevator installation 2 is arranged in an elevator shaft 1. Elevator shaft 1 comprises a plurality of shaft door openings arranged at floors. Elevator installation 2 comprises a plurality of shaft doors 6.1, 6.2, 6.3, wherein a first of shaft doors 6.1 is arranged at a first of the shaft door openings and a second of shaft doors 6.2 is arranged at a second of the shaft door openings. Elevator installation 2 comprises an elevator car 4 comprising a car door 7.

Elevator car 4 is arranged so as to be capable of travel inside elevator shaft 1. In order to ensure adequate safety during the travel of elevator car 4, elevator car 4 is sufficiently spaced apart from the components fixed in elevator shaft 1, in particular shaft doors 6.1, 6.2, 6.3. This spacing is marked by a door threshold gap S. By means of door threshold gap S, the components of the elevator car, for example the car door, are prevented from touching, in particular striking against, components fixed in elevator shaft 1 during the travel of elevator car 4.

Figure 2:
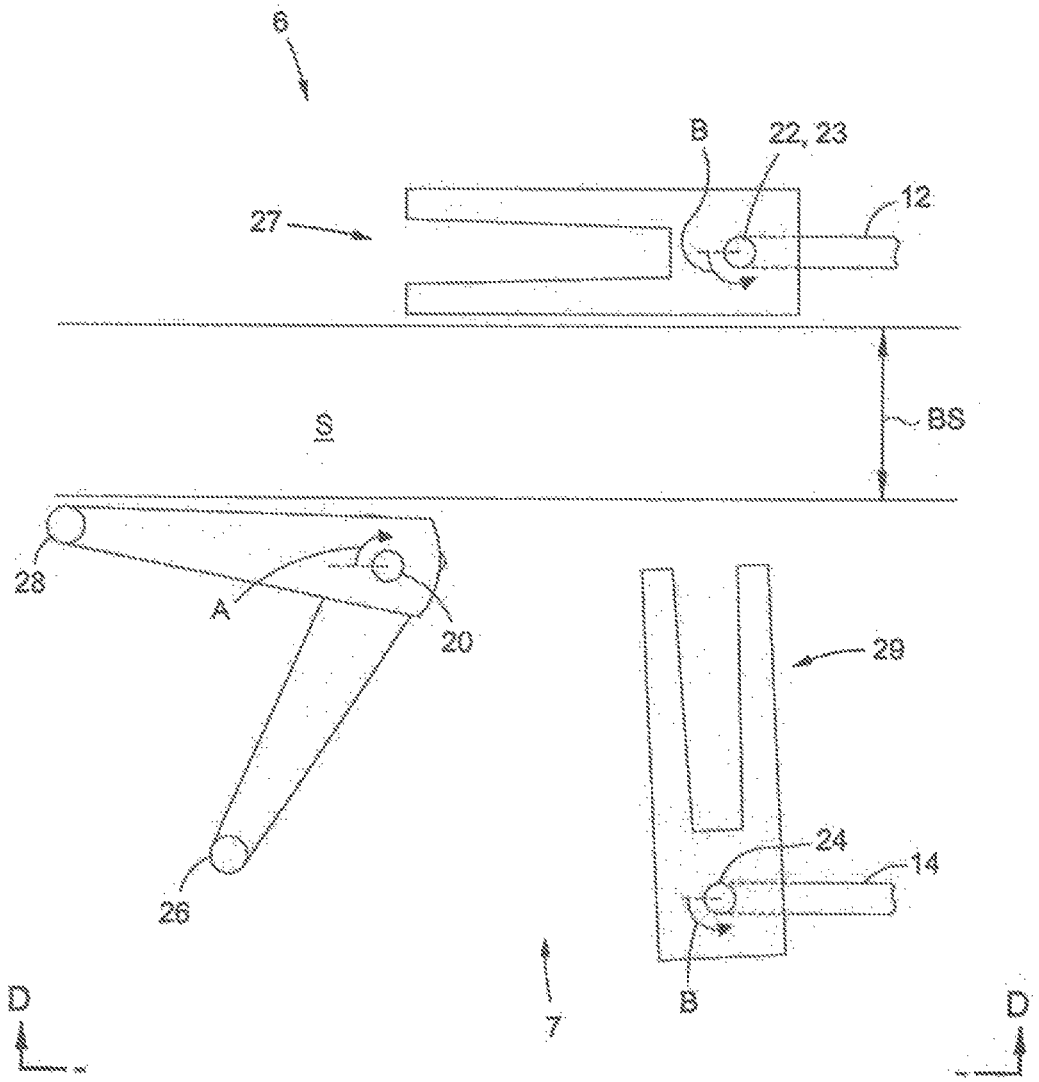
FIG. 2: shows the door system in a closed position in a horizontal cross-section.
Figure 3:
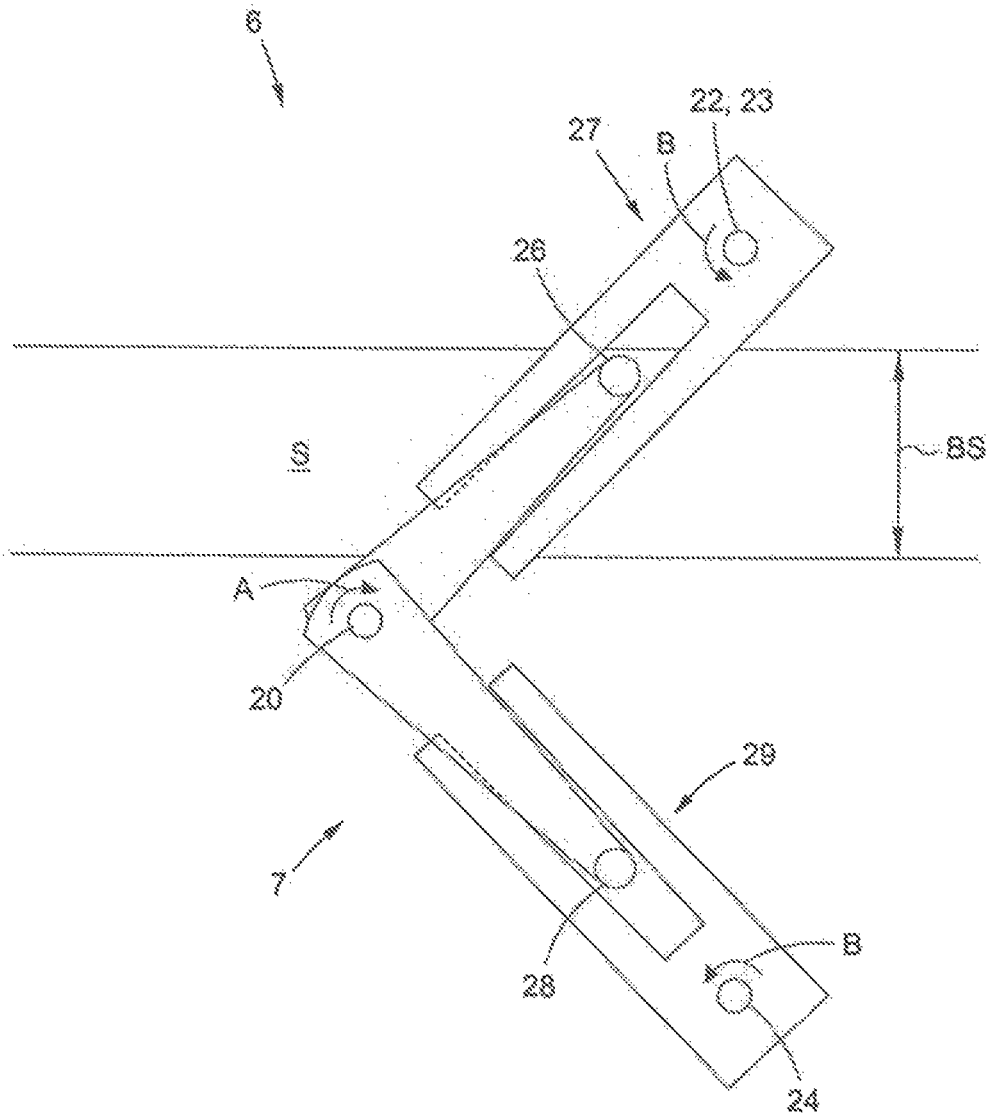
FIG. 3: shows the door system shown in FIG. 2 during an opening movement.
Figure 4:
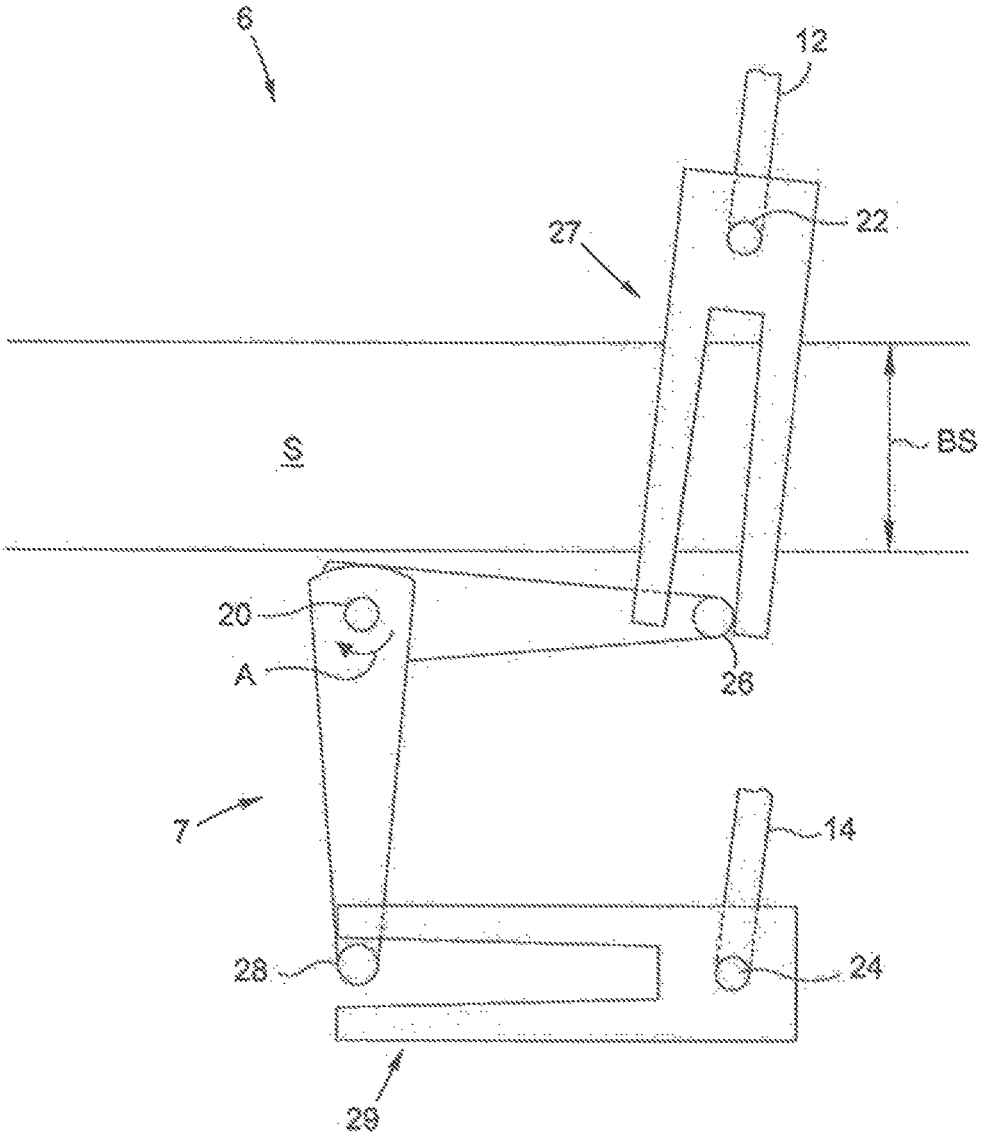
FIG. 4: shows the door system shown in FIGS. 2 and 3 in a horizontal cross-section in an open position.

FIGS. 2, 3 and 4 show a door system for an elevator installation 2 represented in FIG. 1. The door system comprises one such car door 7 arranged on a car door side and one such shaft door 6 arranged on a shaft door side. Car door 7 can comprise a door leaf 14 and shaft door 6 can comprise a further door leaf 12 assignable to shaft door 6. In a closed position of the door system shown according to FIG. 2, car door 7 and shaft door 6 are spaced apart from one another, for example by means of door threshold gap S.

The door system comprises a pivotably mounted shaft 20 of a drive unit and a primary pivot spindle 22. The drive unit comprising shaft 20 is arranged on the car door side. A motor, not represented, can be a component of the drive unit. Shaft 20 can be driven, i.e. is automatically pivoted, by means of this motor. Primary pivot spindle 22 is arranged on the shaft door side. The door system can comprise a secondary pivot spindle 24, which is arranged on the side of the drive unit, i.e. on the car door side. As an alternative to the shown embodiment, driven pivotably mounted shaft 20 and, as the case may be, secondary pivot spindle 24 can be arranged on the shaft door side and primary spindle 22 on the car door side.

A first entraining means (first entrainer) 26 is fixed to pivotable shaft 20. A counterpart element 27 which can be actuated by entraining means 26 is fixed to primary pivot spindle 22. As represented in FIGS. 2 and 4, a door leaf of shaft door and car door 6, 7 assignable respectively to pivot spindle 22, 24 can be fixed to pivot spindle 22 or more precisely to pivot spindles 22, 24.

If the door system comprises secondary pivot spindle 24, a second entraining means (second entrainer) 28 can be fixed to pivotable shaft 20. In this case, a second counterpart element 29 which can be actuated by this second entraining means 28 is fixed to secondary pivot spindle 24. At least one of these entraining means 26, 28 can—as represented—be formed by a cam. Counterpart element 27, 29 which can be actuated by this cam can be constituted as an engaging element.

Shaft 20 of the drive unit is pivotable in the direction of the arrow marked by A. Primary pivot spindle and secondary pivot spindle 22, 24 are also pivotable in the direction of the arrow marked by B.

FIG. 2 shows the door system in a closed position. It can be seen that neither components of car door 7 nor components of shaft door 6 project into door threshold gap S. Shown door threshold gap S extends essentially parallel to door leaves 12, 14 of the door system when they are in their closed position. Door threshold gap S has a width BS. Width BS of door threshold gap S denotes the horizontal spacing of car door 7 from shaft door 6 in the closed position of the door system.

FIGS. 3 and 4 show the door system in a position which does not correspond to the closed position. Accordingly, parts of the car door 7 and shaft door 6, in particular first entraining means 26, counterpart element 27 which can be actuated by first entraining means 26, are arranged in door threshold gap S, more precisely are pivoted into this door threshold gap S.

FIG. 3 shows the door system represented in FIG. 2 in a position, which position can be reached for example with an opening movement of the door system. First entraining means 26 fastened to shaft 20 pivots with pivoting movement A of shaft 20 into counterpart element 27 fastened to primary spindle 22 and accordingly effects pivoting movement B of primary pivot spindle 22. According to the represented embodiment of the door system, second entraining means 28 fastened to shaft 20 also pivots into counterpart element 29 fastened to secondary pivot spindle 24. When pivoting movement A of shaft 20 takes place, secondary pivot spindle 24 is thus also pivoted by means of pivoting movement B. Pivoting movements B of primary pivot spindle 22 and of secondary pivot spindle 24 can take place in synchrony. When a closing movement of the door system takes place, pivoting movements A, B of shaft 20 and of primary and secondary pivot spindles 22, 24 are performed in the opposite direction to the arrows representing these pivoting movements A, B.

FIG. 4 shows the door system represented in FIGS. 2 and 3 in its open position, wherein door leaves 12, 14 of car door and shaft door 6, 7 can be arranged essentially or almost normal to the plane of door threshold gap S. For example, a continued pivoting movement A of shaft 20 is not advisable, because entraining means 26, 28 do not effect any further pivoting movement of primary pivot spindle and secondary pivot spindle 22, 24.

According to the door system shown in FIGS. 2 to 4, primary pivot spindle 22 is arranged coaxial with a pivot spindle 23 of door leaf 12 driven by means of this primary pivot spindle 22.

Figure 5:
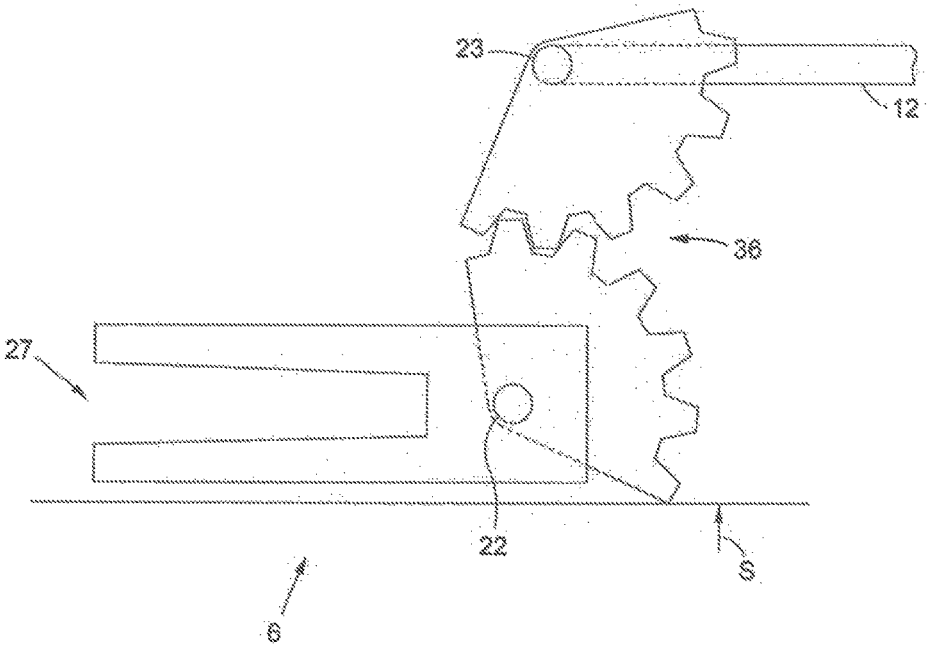
FIG. 5: shows an alternative embodiment of the door system to FIGS. 2 to 4.

FIG. 5 shows an alternatively constituted shaft door 6 of the door system represented by way of example in FIGS. 2 to 4. The door system comprises a primary pivot spindle 22, to which primary pivot spindle 22 counterpart element 27 which can be actuated by an entraining means is fixed. Door leaf 12 which can be coupled to this primary pivot spindle 22 is mounted pivotably on a further pivot spindle 23. Pivot spindle 23 is coupled by means of a coupling gear 36 with primary pivot spindle 22, wherein pivot spindle 23 and primary pivot spindle 22 are arranged on one and the same side of door threshold gap S, here on the shaft door side. Coupling gear 36 itself is represented merely by way of example and can be replaced by any gear that satisfies the purpose of coupling the two pivot spindles 22, 23. The coupling of pivot spindles 22, 23 on the shaft door side represented in FIG. 5 can alternatively or additionally be a component of a car door.

It should be noted that the door leaf, not represented in FIG. 5, of the door arranged on the other side of door threshold gap S, in this case the car door, must be constituted in such a way that door leaf 12 on the shaft door side and the door leaf on the car door side do not collide with a pivoting movement A, B of shaft 20 or of the at least one primary pivot spindle or secondary pivot spindle 22, 24 when the door system is being opened and closed.

Figure 6:
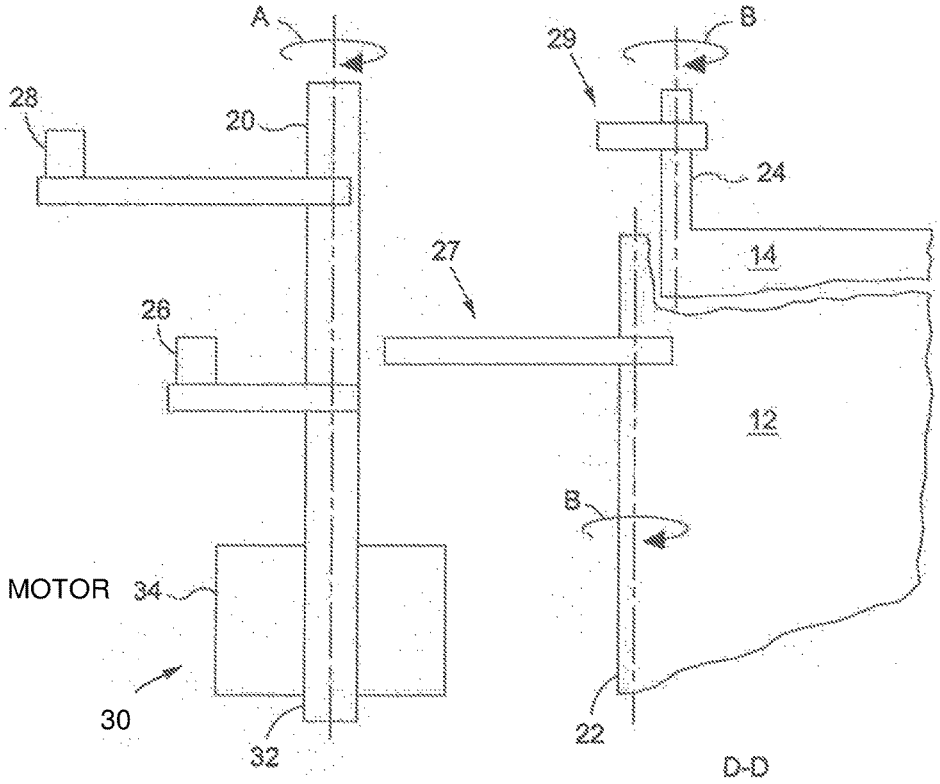
FIG. 6: shows the door system shown in FIGS. 2 to 4 in a vertical cross-section.

FIG. 6 shows the door system shown in FIGS. 2 to 4 in its open position according to view D-D marked in FIG. 2. Shaft 20, primary pivot spindle 22 and secondary pivot spindle 24 are preferably arranged at right angles and/or parallel to one another. In addition to shaft 20, a motor 34 of drive unit 30 is represented. Motor 34 comprises a drive shaft 32. Drive shaft 32 can be arranged coaxial with shaft 20, to which shaft 20 entraining means 26, 28 are fixed. Drive shaft 32 and this shaft 20 can thus be formed by a single shaft 20, 32. Alternatively, a gear unit of drive unit 30 can be arranged between drive shaft 32, motor 34 and shaft 20, in such a way that drive shaft 32 of motor 34 and shaft 20 are arranged coaxially or axially with respect to one another.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A door system for an elevator installation, the elevator installation including an elevator car for travel in an elevator shaft, the door system comprising:

a car door arranged at the elevator car;

a shaft door arranged at a shaft door opening of the elevator shaft, wherein when the car door is adjacent the shaft door the car door and the shaft door are spaced apart by a door threshold gap in a closed position of the door system;

a primary pivot spindle coupled to a pivotable first door leaf of one of the shaft door and the car door, wherein the first door leaf and the primary pivot spindle are arranged on a first side of the door threshold gap, and wherein a first counterpart element is fixed to the primary pivot spindle; and a drive unit including a driven pivotably mounted shaft having a first entrainer fixed thereto, the drive unit being arranged on a second side of the door threshold gap, wherein during a pivoting movement of the shaft by the drive unit, the first entrainer makes direct mechanical contact with the first counterpart element effecting a pivoting movement of the primary pivot spindle and an associated pivoting movement of the first door leaf.

2. The door system according to claim 1 wherein the door system is a folding door system.

3. The door system according to claim 1 wherein the first side is a shaft door side and the second side is a car door side of the door threshold gap, or wherein the first side is the car door side and the second side is the shaft door side of the door threshold gap.

4. The door system according to claim 1 including a further pivot spindle coupled to the first door leaf and arranged coaxial with the primary pivot spindle.

5. The door system according to claim 1 including a secondary pivot spindle having a second door leaf fixed thereto, the secondary pivot spindle being arranged on the second side of the door threshold gap.

6. The door system according to claim 5 including a second entrainer fixed to the shaft and a second counterpart element fixed to the secondary pivot spindle, wherein the second entrainer effects a pivoting movement of the secondary pivot spindle in response to the pivoting movement of the shaft.

7. The door system according to claim 6 wherein the first entrainer and the second entrainer are fixed to the shaft, the first counterpart element is fixed to the primary pivot spindle and the second counterpart element is fixed to the secondary pivot spindle such that the pivoting movements of the primary pivot spindle and the secondary pivot spindle start simultaneously with opening and closing of the door system.

8. The door system according to claim 5 including a further pivot spindle coupled to the second door leaf and arranged coaxial with the secondary pivot spindle.

9. The door system according to claim 1 wherein a drive shaft of a motor of the drive unit and the driven pivotably mounted shaft are arranged coaxially.

10. The door system according to claim 1 wherein the first entrainer is formed as a cam, and the first counterpart element is formed as a cam engaging element.

11. The door system according to claim 1 wherein the shaft and at least one of the primary pivot spindle, a secondary pivot spindle fixed to a second door leaf, and a further pivot spindle fixed to the first door leaf or the second door leaf are arranged essentially at right angles inside the elevator installation.

12. The door system according to claim 1 wherein the shaft and the primary pivot spindle are arranged with axes parallel with one another.

13. An elevator installation including the door system according to claim 1.

14. A door system for an elevator installation, the elevator installation including an elevator car for travel in an elevator shaft, the door system comprising:

a car door arranged at the elevator car;

a shaft door arranged at a shaft door opening of the elevator shaft, wherein when the car door is adjacent the shaft door the car door and the shaft door are spaced apart by a door threshold gap in a closed position of the door system;

a primary pivot spindle coupled to a pivotable first door leaf of one of the shaft door and the car door, wherein the first door leaf and the primary pivot spindle are arranged on a first side of the door threshold gap, and wherein a first counterpart element is fixed to the primary pivot spindle;

a secondary pivot spindle having a second door leaf fixed thereto, the secondary pivot spindle being arranged on a second side of the door threshold gap, and wherein a second counterpart element is fixed to the secondary pivot spindle; and a drive unit including a driven pivotably mounted shaft having a first entrainer and a second entrainer fixed thereto, the drive unit being arranged on a second side of the door threshold gap, wherein during a pivoting movement of the shaft by the drive unit, the first entrainer contacts the first counterpart element effecting a pivoting movement of the primary pivot spindle and an associated pivoting movement of the first door leaf and the second entrainer contacts the second counterpart element effecting a pivoting movement of the secondary pivot spindle and an associated pivoting movement of the second door leaf.

* * * * *